US007658599B2

(12) United States Patent
Lee et al.

(10) Patent No.: US 7,658,599 B2
(45) Date of Patent: Feb. 9, 2010

(54) ROTARY COMPRESSOR WITH A FILLING MEMBER IN THE VANE SLOT

(75) Inventors: Moon-joo Lee, Suwon-si (KR); Jeong-bae Lee, Hwaseong-si (KR); Kyung-jun Han, Incheon (KR); Chun-mo Sung, Hwaseong-si (KR); Chang-joo Shin, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 269 days.

(21) Appl. No.: 11/737,184

(22) Filed: Apr. 19, 2007

(65) Prior Publication Data

US 2008/0056923 A1 Mar. 6, 2008

(30) Foreign Application Priority Data

Aug. 30, 2006 (KR) ..... 10-2006-0083056

(51) Int. Cl.
*F04C 18/356* (2006.01)
*F04C 23/00* (2006.01)

(52) U.S. Cl. ..... 418/60; 418/24; 418/26; 418/63

(58) Field of Classification Search ..... 418/15, 418/16, 23, 24, 25, 26, 27, 59, 22, 60, 62, 418/63, 65

See application file for complete search history.

(56) References Cited

U.S. PATENT DOCUMENTS

| | | | | |
|---|---|---|---|---|
| 2,048,218 | A * | 7/1936 | Philipp | 418/15 |
| 5,015,164 | A * | 5/1991 | Kudou et al. | 418/63 |
| 7,399,170 | B2 * | 7/2008 | Aya et al. | 418/60 |
| 2005/0019190 | A1 | 1/2005 | Lee et al. | |
| 2005/0214137 | A1 * | 9/2005 | Sakaniwa et al. | 417/410.3 |
| 2006/0002809 | A1 * | 1/2006 | Kawabe et al. | 418/63 |
| 2006/0008360 | A1 * | 1/2006 | Nishikawa et al. | 417/244 |
| 2006/0093494 | A1 * | 5/2006 | Kitaichi et al. | 417/415 |
| 2006/0093503 | A1 | 5/2006 | Lee et al. | |

(Continued)

FOREIGN PATENT DOCUMENTS

| | | |
|---|---|---|
| CN | 2074383 | 4/1991 |

(Continued)

OTHER PUBLICATIONS

Chinese Letters Patent issued Oct. 21, 2009 in CN Application No. 200710108953.X.

*Primary Examiner*—Thomas E Denion
*Assistant Examiner*—Mary A Davis
(74) *Attorney, Agent, or Firm*—Stanzione & Kim LLP

(57) ABSTRACT

A rotary compressor including a cylinder to form a compression chamber, and including a vane slot including a vane guide part recessed outward from an inner surface of the compression chamber and an extended part having a width wider than the width of the vane guide part by a predetermined extension width in an outer end area of the vane guide part, a roller to eccentrically rotate in the compression chamber and to compress a medium, a vane reciprocatingly accommodated in the vane slot, and contacted to an outer surface of the roller to divide the compression chamber, and a filling member accommodated in a space of the extension width in the extended part.

18 Claims, 5 Drawing Sheets

U.S. PATENT DOCUMENTS

| | | | | |
|---|---|---|---|---|
| 2006/0216185 | A1* | 9/2006 | Aya et al. | 418/63 |
| 2007/0154329 | A1* | 7/2007 | Onoda | 417/216 |

FOREIGN PATENT DOCUMENTS

| | | | | |
|---|---|---|---|---|
| CN | 1576589 | | | 2/2005 |
| CN | 1763379 | | | 4/2006 |
| CN | 1766338 | | | 5/2006 |
| JP | 06066277 | A | * | 3/1994 |
| JP | 2005171848 | A | * | 6/2005 |
| JP | 2006-22765 | | | 1/2006 |
| JP | 2006-52693 | | | 2/2006 |
| JP | 2007-009861 | | * | 1/2007 |
| KR | 2004-21140 | | | 3/2004 |
| WO | WO 2006016763 | A1 | * | 2/2006 |

* cited by examiner

ROTARY COMPRESSOR WITH A FILLING MEMBER IN THE VANE SLOT

CROSS-REFERENCE TO RELATED APPLICATIONS

This application claims priority under 35 U.S.C. § 119(a) from Korean Patent Application No. 2006-0083056, filed Aug. 30, 2006, in the Korean Intellectual Property Office, the disclosure of which is incorporated herein in its entirety by reference.

BACKGROUND OF THE INVENTION

1. Field of the Invention

The present general inventive concept relates to a rotary compressor, and more particularly, to a rotary compressor with a variable capacity.

2. Description of the Related Art

A conventional cooling apparatus applied to an air conditioner or a refrigerator employs a variable capacity rotary compressor having a variable cooling ability for optimum cooling, and a variable coolant compressing ability for energy saving.

As disclosed in Korean Patent First Publication No. 2004-21140, the variable capacity rotary compressor includes a housing formed with a compression chamber, a rotating shaft having an eccentric part rotating in the compression chamber, a roller rotatably disposed to an outer surface of the eccentric part so that an outer surface of the roller is in contact with an inner surface of the compression chamber, a vane disposed in the housing to reciprocate in a radial direction of the compression chamber with a front end part of the vane being in contact with an outer surface of the roller when the roller rotates, and a restricting means restricting the vane.

The restricting means includes a cylinder coupled to an outer side of the housing to restrict the vane by pressure of an inlet and an outlet of the rotary compressor, a piston disposed in the cylinder to reciprocate in an actuating direction of the vane and accommodating a rear end part of the vane to reciprocate in an inner part of the piston, a first channel communicating with an inner part of the cylinder, a second channel connecting the outlet of the rotary compressor and the first channel, a third channel connecting the inlet of the rotary compressor and the first channel, and a channel changing valve disposed at a junction where the first, second, and third channels are connected.

Here, the cylinder forms an extended space having a width relatively greater than the width of the vane to a rear end area of a vane coupling groove in which the vane is accommodated. By controlling pressure of the extended space, reciprocating of the vane is controlled.

However, in the conventional rotary compressor, since the extended space formed to a rear end area of the vane has a width excessively greater than the width of the vane, a large amount of compressed media is required to actuate the vane. Accordingly, an actuating response speed of the vane is deteriorated, and an actuating noise of the vane is generated.

SUMMARY OF THE INVENTION

The present general inventive concept provides a rotary compressor to improve an operating response speed of a vane, and to reduce noises due to motion of the vane.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a rotary compressor, including a cylinder to form a compression chamber, and including a vane slot including a vane guide part recessed outward from an inner surface of the compression chamber and an extended part having a width wider than the width of the vane guide part by a predetermined extension width in an outer end area of the vane guide part, a roller to eccentrically rotate in the compression chamber and to compress a compressed media, a vane reciprocatingly accommodated in the vane slot, and contacted to an outer surface of the roller to divide the compression chamber, and a filling member accommodated in a space of the extension width in the extended part.

The rotary compressor may further include a predetermined spare gap which is provided in a width direction of the vane between the filling member and the vane.

A thermal deformation temperature of the filling member may be higher than a maximum compression temperature of the compressed media.

The foregoing and/or other aspects and utilities of the present general inventive concept can also be achieved by providing a rotary compressor including a cylinder which forms a first compression chamber and a second compression chamber divided form each other and includes a first and a second vane slots recessed from inner surfaces of the first and the second compression chambers, the first vane slot including a first vane guide part recessed from an inner surface of the (first) compression chamber, and an extended part having a width wider than the width of the first vane guide part by a predetermined extension width, the rotary compressor further including a first roller to eccentrically rotate in the first compression chamber and to compress a compressed media, a first vane reciprocatingly accommodated in the first vane slot, and contacted to an outer surface of the first roller to divide the first compression chamber, and a filling member accommodated in a space of the extension width in the extended part.

A predetermined spare gap may be provided in a width direction of the first vane between the filling member and the first vane.

A thermal deformation temperature of the filling member may be higher than a maximum compression temperature of the compressed media.

The rotary compressor may further include a second roller to eccentrically rotate in the second compression chamber and to compress the media, a second vane reciprocatingly accommodated in the second vane slot, and contacted to an outer surface of the second roller to divide the second compression chamber, and a vane spring provided to the second vane slot to supply an elastic force to the second vane so that the second vane is contacted to the second roller.

The foregoing and/or other aspects and utilities of the present invention general inventive concept can also be achieved by providing a rotary compressor, including a first compression chamber to house a first media to be compressed, a first vane slot recessed radially outward from the first compression chamber, a first vane disposed in the first vane slot to move based on a compressed state of the first media to divide the first compression chamber, a first extended part disposed at an end of the first vane slot furthest from the first compression chamber to prevent the first vane from shaking, and a first filling part disposed in the first extended part to minimize an amount of compressed first media needed to move the first vane.

The first filling part may further prevent the first vane from moving in a direction perpendicular to the movement of the first vane based on the compression state of the first media.

The rotary compressor may further include a fixing unit to fix the first extended part to the first vane when the first vane contacts an inner wall of the first extended part.

The fixing portion may include a magnet disposed in the inner wall of the first extended part to fix the first vane to the first extended part to prevent the first vane from moving.

The rotary compressor may further include a second compression chamber to house a second media to be compressed, a second vane slot recessed radially outward from the second compression chamber, a second vane disposed in the second vane slot to move based on a compressed state of the second media to divide the second compression chamber, a second extended part disposed at an end of the second vane slot furthest from the second compression chamber to prevent the second vane from shaking, and a second filling part disposed in the second extended part to minimize an amount of compressed second media needed to move the second vane.

The first compression chamber and the second compression chamber may have different compression capacities.

The rotary compressor may further include a first control part to selectively move the first vane to vary the compression capacity in the first compression chamber, and a second control part to selectively move the second vane to vary the compression capacity in the second compression chamber.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
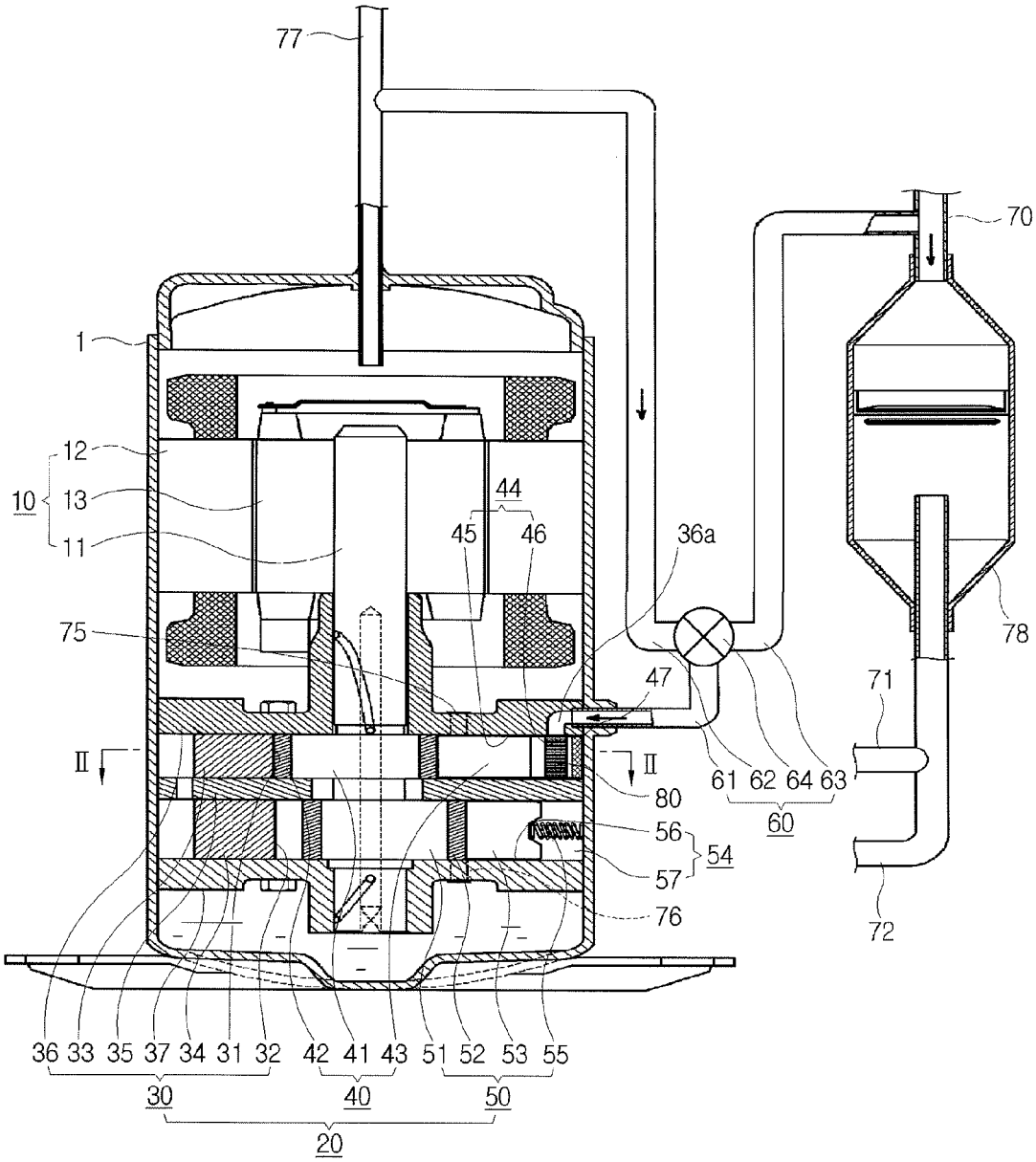
FIG. 1 is a vertical sectional view illustrating a state of a compressing operation in a first compression chamber of a rotary compressor according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

As illustrated in FIG. 1, a rotary compressor according to an embodiment of the present general inventive concept includes a gearing part 10 installed in an upper inner part of an airtight container 1, and a compressing part 20 installed in a lower inner part of the airtight container 1 and connected with the gearing part 10 by a rotating shaft 11.

The gearing part 10 includes a stator 12 fixed to an inner surface of the airtight container 1 and having a cylindrical shape, and a rotor 13 rotatably disposed inside the stator 12 and coupled to the rotating shaft 11 by a central part thereof. When power is supplied, the rotor 13 rotates so that the gearing part 10 actuates the compressing part 20 connected by the rotating shaft 11.

The compressing part 20 includes a cylinder 30 divided to have a first compression chamber 31 provided to an upper part thereof and a second compression chamber 32 provided to a lower part thereof, and a first compression unit 40 and a second compressing unit 50 provided in the first compression chamber 31 and the second compression chamber 32, respectively, to be actuated by the rotating shaft 11.

The cylinder 30 includes a first body 33 provided to an upper part of the cylinder 30 and formed with the first compression chamber 31, a second body 34 provided to a lower part of the cylinder 30 and formed with the second compression chamber 32, a central plate 35 disposed between the first body 33 and the second body 34 to divide the first compression chamber 31 and the second compression chamber 32, and a first flange 36 and a second flange 37 mounted to an upper part of the first body 33 and a lower part of the second body 34, respectively, to close an upper opening of the first compression chamber 31 and a lower opening of the second compression chamber 32, and to concurrently support the rotating shaft 11. The rotating shaft 11 passes centers of the first compression chamber 31 and the second compression chamber 32, and is connected to the compressing unit 40 and the compressing unit 50 in the first compression chamber 31 and the second compression chamber 32, respectively.

The first compressing unit 40 and the second compressing unit 50 include a first eccentric part 41 and a second eccentric part 51, respectively provided to the rotating shaft 11 of the first compression chamber 31 and the second compression chamber 32, and a first roller 42 and a second roller 52 rotatably coupled to outer surfaces of the first eccentric part 41 and the second eccentric part 51, respectively, to rotate in contact with inner surfaces of the first compression chamber 31 and the second compression chamber 32. The first eccentric part 41 and the second eccentric part 51 have eccentric directions opposite to each other to maintain balance. The first roller 42 and the second roller 52 eccentrically rotate in the first compression chamber 31 and the second compression chamber 32, respectively to compress media.

Figure 2:
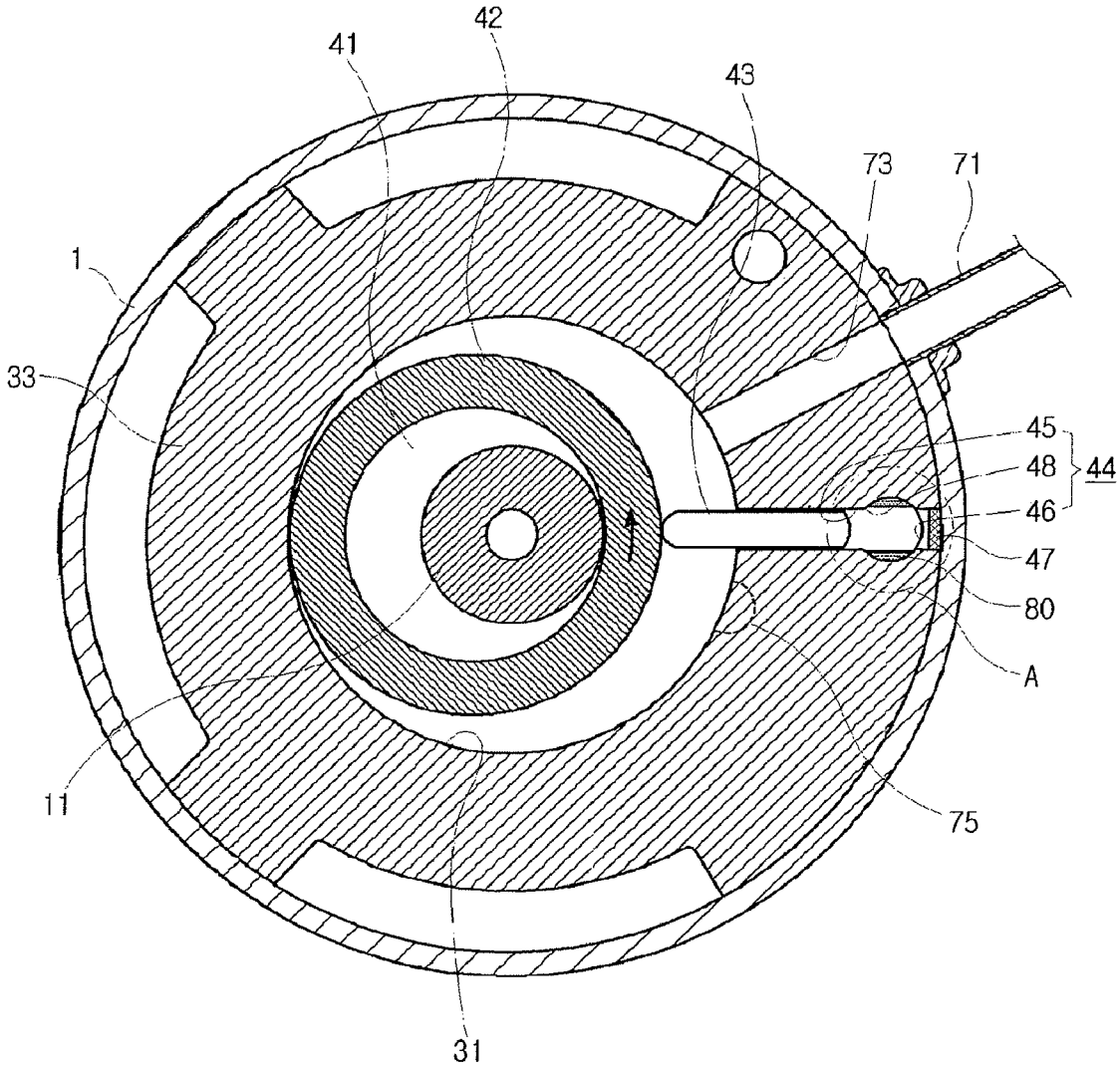
FIG. 2 is a horizontal sectional view taken along line II-II in FIG. 1.
Figure 3:
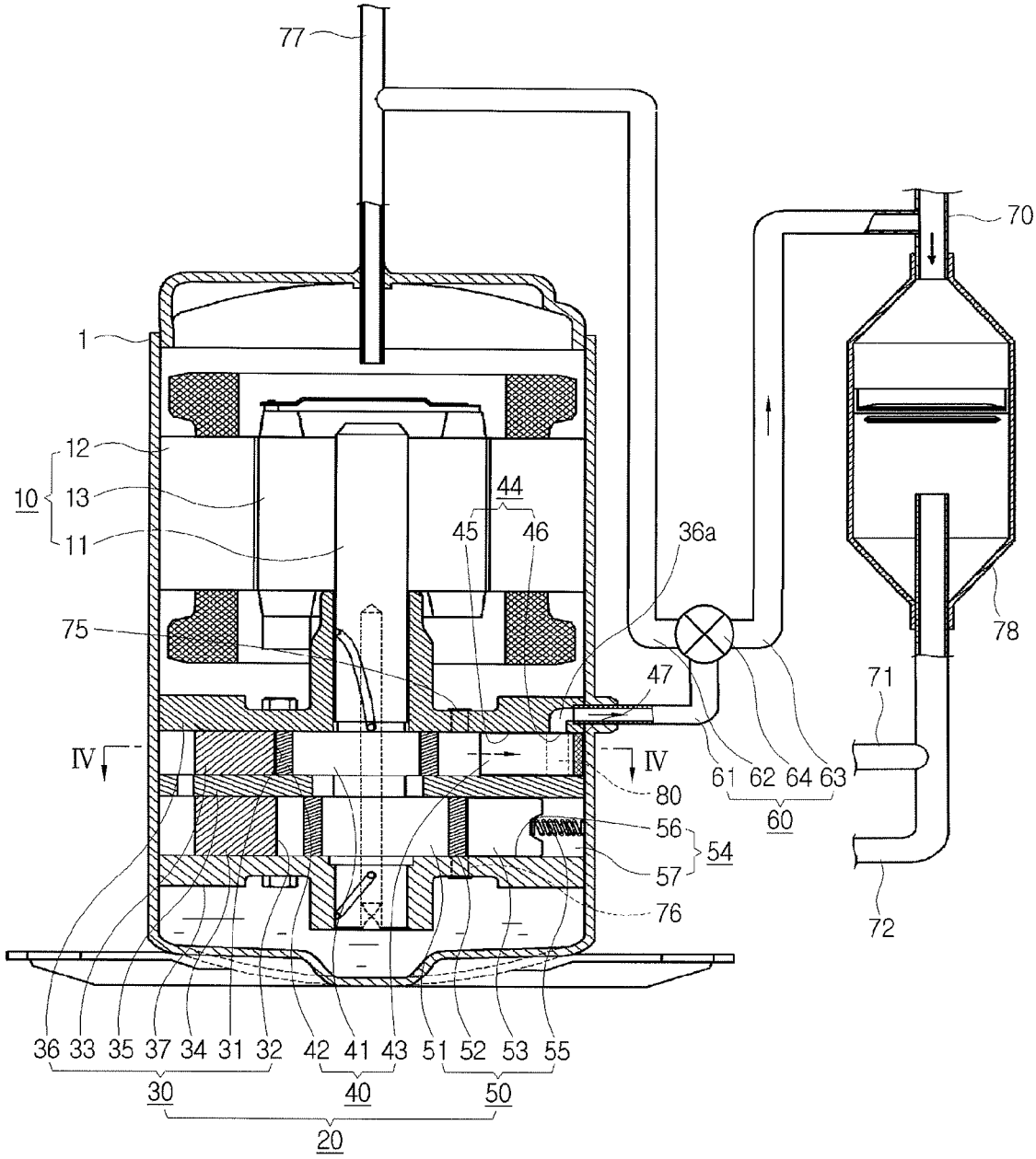
FIG. 3 is a vertical sectional view illustrating an idle state in the first compression chamber of the rotary compressor according to an embodiment of the present general inventive concept.
Figure 4:
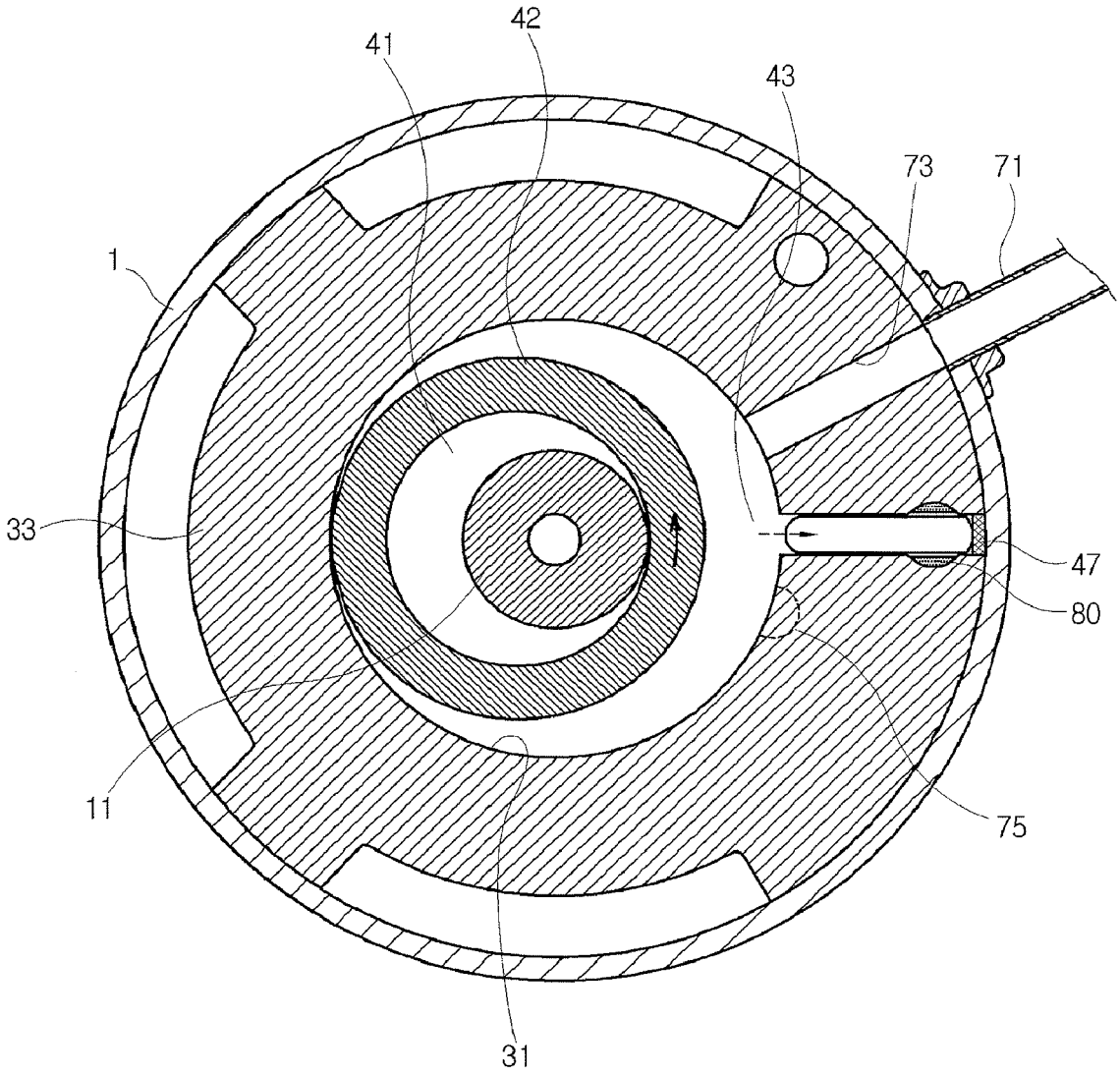
FIG. 4 is a horizontal sectional view taken along line IV-IV in FIG. 3.

The first compressing unit 40 and the second compressing unit 50 include a first vane 43 and a second vane 53 to divide the first compression chamber 31 and the second compression chamber 32 by reciprocating in radial directions according to the rotation of the first roller 42 and the second roller 52, respectively. Referring to FIGS. 1 and 2, the first vane 43 and the second vane 53 reciprocate by being accommodated and guided in a first vane slot 44 and a second vane slot 54, respectively, and are elongated in radial directions of the first compression chamber 31 and the second compression chamber 32. The first vane 43 and the second vane 53 contact outer surfaces of the first roller 42 and the second roller 52, respectively, to divide the first compression chamber 31 and the second compression chamber 32.

The first body 33 and the second body 34 are formed with the first vane slot 44 and the second vane slot 54 to accommodate the first vane 43 and the second vane 53, respectively, and to guide the first vane 43 and the second vane 53 to move in and out of the first compression chamber 31 and the second compression chamber 32, respectively.

The first vane slot 44 includes a first vane guide part 45 to guide the first vane 43 in an inner surface of the first compression chamber 31, and an extended part 46 having a width wider than a width of the first vane guide part 45 in an outer end area of the first vane guide part 45.

The first vane guide part 45 is recessed outward to have a width corresponding to a width of the first vane 43 in an inner surface of the first compression chamber 31 to provide a passage for the first vane 43. The first vane guide part 45 accommodates the first vane 43, and guides the first vane 43 to move in and out of the first compression chamber 31.

The extended part 46 has a width greater than the width of the first vane guide part 45 by a predetermined extended width in an outer end area of the first vane guide part 45 (i.e., an area furthest from center of the compression chamber 31). That is, the extended part 46 provides a passage having a width wider than a width of the first vane guide part 45. A trimmed part 48 is formed at a boundary between the extended part 46 and the first vane guide part 45 by a chamfering process. By forming the trimmed part 48, actuation of the first vane 43 can perform successfully. The extended part 46 is formed during a manufacturing process of the trimmed part 48 of the first vane slot 44.

The extended part 46 is divided from an inner space of the airtight container 1 by the central plate 35 and the first flange 36. A rear end of the first vane 43 may have a curved surface corresponding to an inner surface of the extended part 46. A magnet 47 is disposed in a rear portion of the extended part 46 which is contacted with a rear end of the first vane 43 to be fixedly attached to the first vane 43 so that the first vane 43 is prevented from swaying when the first vane 43 completely retreats. Since the rear end of the first vane 43 has a curved surface, the rear end of the first vane 43 can be easily contacted to the magnet 47 when the first vane 43 retreats.

The rotary compressor according to an embodiment of the present general inventive concept also includes a first vane control part 60 to supply a suction pressure to the extended part 46 to maintain the first vane 43 in a retreating state, and to supply a discharge pressure to the extended part 46 to allow the first vane 43 to reciprocate. With this configuration, the first vane control part 60 restricts or releases the first vane 43 so that compressing or idling is completed in the first compression chamber 31, thereby varying a compression capacity. The second vane slot 54 includes a second vane guide part 56 recessed outward in an inner surface of the second compression chamber 32 to guide the second vane 53, and a vane spring accommodating part 57 provided with a vane spring 55 to press the second vane 53 toward the second roller 52 so that the second vane 53 divides the second compression chamber 32.

A suction hole 73 connected with suction pipes 71 and 72 to supply gas into the first compression chamber 31 and the second compression chamber 32, and discharge holes 75 and 76 to discharge gas compressed in the first compression chamber 31 and the second compression chamber 32 into the airtight container 1, are formed in the first body 33 and the second body 34, respectively. Accordingly, when the rotary compressor is actuated, the inside of the airtight container 1 maintains a high pressure by the compressed gas discharged through the discharge holes 75 and 76, and the compressed gas in the airtight container 1 is guided to outside the rotary compressor through a discharge pipe 77 which is provided to an upper part of the airtight container 1.

A sucked gas is guided to the suction hole 73 of the respective compression chambers 31 and 32 through the suction pipes 71 and 72, via an accumulator 78.

Referring to FIG. 1, the first vane control part 60 includes a connecting pipe 61 to directly communicate with the extended part 46 in a rear part of the first vane slot 44, a high pressure pipe 62 to connect the connecting pipe 61 and the discharge pipe 77, a low pressure pipe 63 connect the connecting pipe 61 and a suction tube 70, and a regulating valve 64 to selectively connect the high pressure pipe 62 or the low pressure pipe 63 to the connecting pipe 61. The regulating valve 64 includes a motor-driven three way valve disposed in a junction where the connecting pipe 61, the high pressure pipe 62 and the low pressure pipe 63 are connected. An outlet of the connecting pipe 61 is connected to the first flange 36, and the first flange 36 is formed with a communicating channel 36*a* to directly connect the connecting pipe 61 and the extended part 46. That is, the extended part 46 is provided to the rear part of the first vane slot 44, and the connecting pipe 61 is connected to the first flange 36 to directly communicate with the extended part 46.

The rotary compressor according to an embodiment of the present general inventive concept further includes a filling member 80 accommodated in the space of the extended part 46 which is enlarged in width. The filling member 80 reduces a space capacity of the extended part 46 to decrease an actuating time of the first vane 43. When the first vane 43 is actuated by the compressed media having a high pressure, since the amount of the compressed media is reduced, a response of the first vane 43 can be improved. Also, when the first vane 43 is moved, the filling member 80 can prevent a rear end part of the first vane 43 from trembling in the widened space of the extended part 46. That is, the filling member 80 can prevent a chattering. Accordingly, noises due to motion of the first vane 43 can be reduced.

The filling member 80 may be formed of material with a good thermal property. A threshold thermal deformation temperature of the filling member 80 may be higher than a maximum compression temperature of the compressed media. Also, the filling member 80 may be formed of material to endure a maximum pressure of the first compression chamber 31. However, the present general inventive concept is not limited to the aforementioned materials.

Figure 5:
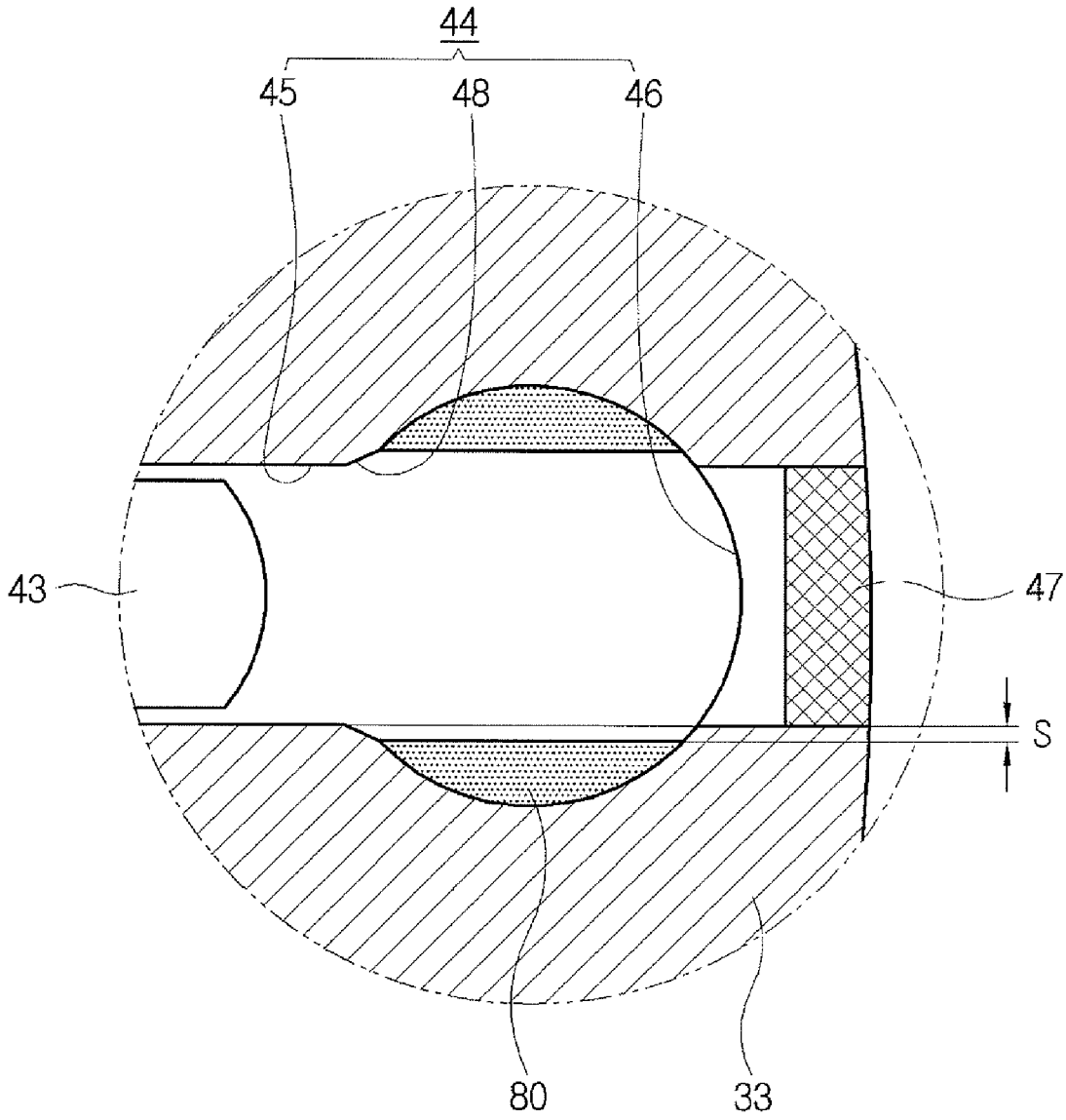
FIG. 5 is an enlarged view of area A in FIG. 2.

Referring to FIG. 5, when compressing is not performed in the first compression chamber 31, a predetermined marginal extra interval S is provided between the filling member 80 and the first vane 43 in a state in which the first vane 43 is distanced from the first roller 42 to be accommodated in the first vane slot 44 (i.e., a restricted position). Accordingly, the first vane 43 can maintain an optimal operation condition. Also, a height of the filling member 80 may be approximately equal to a height of the first compression chamber 31.

Hereinafter, an operating process of the rotary compressor according to the embodiment of the present general inventive concept will be described by referring to FIGS. 1 through 5.

Referring to FIGS. 1 and 2, when the regulating valve 64 operates so that the high pressure pipe 62 communicates with the connecting pipe 61, a discharge pressure is applied to the extended part 46. Accordingly, since the first vane 43 is pushed toward the first compression chamber 31 by the discharge pressure, the first vane 43 reciprocates according to an eccentric rotation of the first roller 42. In contrast, referring to FIGS. 3 and 4, when the regulating valve 64 operates so that the low pressure pipe 63 communicates with the connecting pipe 61, a suction pressure is applied to the extended part 46. Accordingly, since the first vane 43 retreats to be suspended, idling occurs in the first compression chamber 31. When the first vane 43 retreats to be suspended, the rear end of the first vane 43 is attached to the magnet 47 to prevent the first vane 43 from being shaken. That is, although a pressure variation happens in the first compression chamber 31 by an idling of the first roller 42 in the first compression chamber 31, the first vane 43 can be prevented from trembling and can perform a silent operation. By providing the filling member 80 to the space of the extended part 46, a response speed of the first vane 43 can be improved, and noises due to operation of the first vane 43 can be reduced.

With this configuration, since the rotary compressor according to an embodiment of the present general inventive concept controls restricting of the first vane 43 by the first vane control part 60, compressing or idling can be completed in the first compression chamber 31, thereby varying a compression capacity therethrough. That is, when the discharge pressure is applied to the extended part 46 so that the first vane 43 reciprocates, compressing is completed in all of the first compression chamber 31 and the second compression chamber 32, thereby completing a big capacity compression. In contrast, when the suction pressure is applied to the extended part 46 to restrict the first vane 43, idling is performed in the first compression chamber 31 and compressing is performed in only the second compression chamber 32, thereby reducing a compression capacity.

In an embodiment of the present general inventive concept, the rotary compressor includes only the first vane control part 60. Alternatively, the first compression chamber 31 and the second compression chamber 32 may have different capacities, and a second van control part (not illustrated) may be further provided to control restricting of the second vane 53. Here, the second vane control part may have a same operation principle as the first vane control part 60. Accordingly, compression capacity can be varied by making capacities of the first compression chamber 31 and the second compression chamber 32 different, and controlling the first vane control part 60 and the second vane control part to selectively restrict the first vane 43 or the second vane 53. For example, by following various cases of an idling rotation in the first compression chamber 31 and a compressing rotation in the second compression chamber 32, a compressing rotation in the first compression chamber 31 and an idling rotation in the second compression chamber 32, and a compressing rotation in the first compression chamber 31 and the second compression chamber 32, a compression capability may be changed in various ways. Also, a rotating speed variation of the gearing part 10 together with the mechanical compression capacity variation may further diversify a variable range of the compression capacity.

With this configuration, by providing a filling member accommodated in an extended part having a width wider than a width of a vane guide part by a predetermined extension width, an operating response speed of a vane can be improved, and noises due to motion of the vane can be reduced.

As described above, the present general inventive concept provides a rotary compressor to improve an operating response speed of a vane, and to reduce noises due to motion of the vane.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A rotary compressor, comprising:

a cylinder internally formed with a compression chamber;

a rotating shaft penetrating a central area of the compression chamber;

a roller eccentrically coupled to the rotating shaft, and eccentrically rotatable within the compression chamber by rotation of the rotating shaft to compress media;

a vane contacting an outer surface of the roller to partition the compression chamber and reciprocating in a radial direction of the compression chamber as the roller eccentrically rotates;

a vane slot comprising, a vane guide part formed on a wall of the compression chamber to accommodate and guide the vane to reciprocate, and an extension width part formed an outer end part of the vane guide part and larger than a width of the vane guide part by a predetermined extension width;

the extension width part is in selective fluid communication with either the discharge pipe or a low pressure pipe in order to move the vane into either engagement or disengagement with the roller; and a capacity reduced part inserted in the extension width of the extension width part with a predetermined space apart from the vane guide part and reducing capacity of the extension width part to decrease the actuating time of the vane.

2. The rotary compressor according to claim 1, wherein a thermal deformation temperature of the capacity reduced part is higher than a maximum compression temperature of the compressed media.

3. A rotary compressor, comprising:

a cylinder internally formed with a first compression chamber with a first vane slot recessed from an inner surface therein, and a second compression chamber with a second vane slot recessed from an inner surface therein, wherein the first compression chamber and the second compression chamber are divided from each other;

a rotating shaft penetrating a central area of the first compression chamber;

a first roller eccentrically coupled to the rotating shaft, and eccentrically rotatable within the first compression chamber by rotation of the rotating shaft to compress media;

a first vane contacting an outer surface of the first roller to partition the compression chamber and reciprocating in a radial direction of the compression chamber as the first roller eccentrically rotates;

the first vane slot comprising a first vane guide part formed on a wall of the compression chamber to accommodate and guide the first vane to reciprocate, and an extension width part formed an outer end part of the first vane guide part and larger than a width of the first vane part by a predetermined extension width;

the extension width part is in selective fluid communication with either the discharge pipe or a low pressure pipe in order to move the vane into either engagement or disengagement with the roller; and a filling member inserted in the extension width of the extension width part with a predetermined space apart from the first vane guide part and reducing capacity of the extension width part to decrease the actuating time of the vane.

4. The rotary compressor according to claim 3, wherein a predetermined spare gap is provided in a width direction of the first vane between the filling member and the first vane.

5. The rotary compressor according to claim 4, further comprising:

a second roller to eccentrically rotate in the second compression chamber and to compress the media;

a second vane reciprocatingly accommodated in the second vane slot, and contacted to an outer surface of the second roller to divide the second compression chamber; and a vane spring provided to the second vane slot to supply an elastic force to the second vane so that the second vane is contacted to the second roller.

6. The rotary compressor according to claim 3, wherein a thermal deformation temperature of the filling member is higher than a maximum compression temperature of the compressed media.

7. The rotary compressor according to claim 6, further comprising:

a second roller to eccentrically rotate in the second compression chamber and to compress the media;

a second vane reciprocatingly accommodated in the second vane slot, and contacted to an outer surface of the second roller to divide the second compression chamber; and a vane spring provided to the second vane slot to supply an elastic force to the second vane so that the second vane is contacted to the second roller.

8. The rotary compressor according to claim 3, further comprising:

a second roller to eccentrically rotate in the second compression chamber and to compress the media;

a second vane reciprocatingly accommodated in the second vane slot, and contacted to an outer surface of the second roller to divide the second compression chamber; and a vane spring provided to the second vane slot to supply an elastic force to the second vane so that the second vane is contacted to the second roller.

9. A rotary compressor, comprising:

a cylinder internally formed with a first compression chamber;

a rotating shaft penetrating a central area of the first compression chamber;

a roller eccentrically coupled to the rotating shaft, and eccentrically rotatable within the first compression chamber by rotation of the rotating shaft;

the first compression chamber to house a first medium to be compressed;

a first vane slot recessed radially outward from the first compression chamber comprising a first vane guide part formed on a wall of the first compression chamber;

a first vane disposed in the first vane slot to move based on a compressed state of the first medium to divide the first compression chamber and reciprocating in a radial direction of the first compression chamber as the roller eccentrically rotates;

a first extended part disposed at an end of the first vane slot furthest from the first compression chamber to prevent the first vane from shaking and larger than a width of the first vane guide part by a predetermined extension width; and a first filling part disposed in the first extended part with a predetermined space apart from the first vane guide art and reducing capacity of the extension width art to minimize an amount of the compressed first medium needed to move the first vane.

10. The rotary compressor of claim 9, wherein the first filling part further prevents the first vane from moving in a direction perpendicular to the movement of the first vane based on the compression state of the first medium.

11. The rotary compressor of claim 9, further comprising:

a fixing unit to fix the first extended part to the first vane when the first vane contacts an inner wall of the first extended part.

12. The rotary compressor of claim 11, wherein the fixing unit comprises:

a magnet disposed in the inner wall of the first extended part to fix the first vane to the first extended part to prevent the first vane from moving.

13. The rotary compressor of claim 9, further comprising a second compression chamber to house a second medium to be compressed;

a second vane slot recessed radially outward from the second compression chamber;

a second vane disposed in the second vane slot to move based on a compressed state of the second medium to divide the second compression chamber;

a second extended part disposed at an end of the second vane slot furthest from the second compression chamber to prevent the second vane from shaking; and a second filling part disposed in the second extended part to minimize an amount of the compressed second medium needed to move the second vane.

14. The rotary compressor of claim 13, wherein the first compression chamber and the second compression chamber have different compression capacities.

15. The rotary compressor of claim 13, further comprising:

a first control part to selectively move the first vane to vary the compression capacity in the first compression chamber; and a second control part to selectively move the second vane to vary the compression capacity in the second compression chamber.

16. A rotary compressor, comprising:

a cylinder internally formed with a compression chamber;

a rotating shaft penetrating a central area of the compression chamber;

a roller eccentrically coupled to the rotating shaft, and eccentrically rotatable within the compression chamber by rotation of the rotating shaft;

a vane contacting an outer surface of the roller to partition the compression chamber and reciprocating in a radial direction of the compression chamber as the roller eccentrically rotates;

a vane slot comprising a vane guide part formed on a wall of the compression chamber to accommodate and guide the vane to reciprocate, and an extension width part formed an outer end part of the vane guide part and larger than a width of the vane guide part by a predetermined extension width;

the extension width part is in selective fluid communication with either the discharge pipe or a low pressure pipe in order to move the vane into either engagement or disengagement with the roller; and a capacity reduced part inserted in and fixed to an area of the extension width of the extension width part and reducing capacity of the extension width part to decrease the actuating time of the vane.

17. A rotary compressor, comprising:

a cylinder internally formed with a first compression chamber with a first vane slot recessed from an inner surface therein, and a second compression chamber with a second vane slot recessed from an inner surface therein, wherein the first compression chamber and the second compression chamber are divided from each other;

a rotating shaft penetrating a central area of the first compression chamber;

a first roller eccentrically coupled to the rotating shaft, and eccentrically rotatable within the first compression chamber by rotation of the rotating shaft to compress a media;

a first vane contacting an outer surface of the first roller to partition the compression chamber and reciprocating in a radial direction of the compression chamber as the first roller eccentrically rotates;

the first vane slot comprising a first vane guide part formed on a wall of the compression chamber to accommodate and guide the first vane to reciprocate, and an extension width part formed an outer end part of the first vane guide part and larger than a width of the first vane guide part by a predetermined extension width;

the extension width part is in selective fluid communication with either the discharge pipe or a low pressure pipe in order to move the vane into either engagement or disengagement with the roller; and a capacity reduced part inserted in and fixed to an area of the extension width of the extension width part and reducing the capacity of the extension width part to decrease the actuating time of the vane.

18. A rotary compressor, comprising:

a cylinder internally formed with a first compression chamber with a first vane slot recessed from an inner surface therein, and a second compression chamber with a second vane slot recessed from an inner surface therein, wherein the first compression chamber and the second compression chamber are divided from each other;

a rotating shaft penetrating a central area of the first compression chamber;

a first roller eccentrically coupled to the rotating shaft, and eccentrically rotatable within the first compression chamber by rotation of the rotating shaft;

a first vane contacting an outer surface of the first roller to partition the first compression chamber and reciprocating in a radial direction of the first compression chamber as the first roller eccentrically rotates;

a first vane slot comprising a first vane guide part formed on a wall of the first compression chamber to accommodate and guide the first vane to reciprocate, and an extension width part formed an outer end part of the first vane guide part and larger than a width of the first vane guide part by a predetermined extension width;

the extension width part is in selective fluid communication with either the discharge pipe or a low pressure pipe in order to move the vane into either engagement or disengagement with the roller;

a capacity reduced part inserted in and fixed to an area of the extension width of the extension width part and reducing capacity of the extension width part to decrease the actuating time of the vane;

a second roller to eccentrically rotate in a second compression chamber and to compress a media;

a second vane reciprocatingly accommodated in a second vane slot, and contacted to an outer surface of the second roller to divide the second compression chamber; and a vane spring provided to the second vane slot to supply an elastic force to the second vane so that the second vane is contacted to the second roller.

* * * * *